United States Patent [19]

Kaufmann

[11] 3,935,822

[45] Feb. 3, 1976

[54] MONORAIL TROLLEY

[75] Inventor: Karl Ernst Kaufmann, Wetter, Germany

[73] Assignee: Demag Aktiengesellschaft, Germany

[22] Filed: Aug. 26, 1974

[21] Appl. No.: 500,353

[30] Foreign Application Priority Data

Aug. 29, 1974 Germany ..... 2343502

[52] U.S. Cl. ..... 104/93; 104/109; 105/153; 191/30

[51] Int. Cl.[2] ..... B61B 3/02

[58] Field of Search ..... 104/89, 91, 93, 106, 107, 104/109, 110, 118, 119, 172 S, 229, 230, 232, 233, 234, 148 LM; 105/148, 150, 151, 153; 191/30

[56] References Cited

UNITED STATES PATENTS

| | | | |
|---|---|---|---|
| 299,394 | 5/1884 | Jenkins | 104/93 |
| 3,192,872 | 7/1965 | Parent | 104/93 |
| 3,625,158 | 12/1971 | Lorenz et al. | 104/93 |

*Primary Examiner*—Robert J. Spar
*Assistant Examiner*—Randolph A. Reese
*Attorney, Agent, or Firm*—Mandeville and Schweitzer

[57] ABSTRACT

Disclosed herein is an improved trolley truck traveling on a monorail having spaced horizontal surfaces, in which a frame of the truck supports at least one supporting or traction wheel on the upper surface of the rail and a counterwheel on the lower surface of the rail, the separation of the wheels being greater than the vertical spacing of the horizontal rail surfaces to accommodate rapid and easy placement of the truck upon and/or removal of the truck from the monorail.

9 Claims, 5 Drawing Figures

MONORAIL TROLLEY

BACKGROUND AND SUMMARY OF THE INVENTION

The prior art discloses a trolley having two upper supporting or traction wheels connected with a lower counterwheel by a parallelogram linkage. On a horizontal stretch of track, the counterwheel adheres to the rail without pressure, while on inclines it is pressed to the lower rail surfaces from below by the parallel displacement of the linkage. A disadvantage of this arrangement is that, should removal from and/or replacement upon the rail be necessary, this cannot be done without substantial disassembly of the entire mechanism.

It is the object of the present invention to provide a trolley truck structure which may easily be placed upon the rail and just as easily be removed therefrom. This is achieved, in accordance with the invention, by spacing the wheels (supporting or traction wheel, counterwheel which engage the upper and lower bearing surfaces of the rail) a greater distance apart than the actual vertical spacing between the two parallel bearing surfaces of the rail in a manner in which the center of gravity of both the loaded and empty trolley truck is laterally displaced with respect to the points of contact between the rail and the supporting wheel and the counterwheel, to cause both wheels to engage firmly and adhere to the rail. This design enhances the friction between rail and wheels which serves to secure the truck on the bearing surfaces of the rail, and, as in the case of certain modified embodiments, upon any guides arranged adjacent the rail or forming part of the rail. By having a greater distance between supporting and counterwheel than that between the bearing surfaces of the rail, it is possible to cancel the friction by pivoting the trolley truck, itself, about a horizontal lateral axis. In this position, the trolley may be easily removed from the rail by simultaneous tilting. If the traction wheel actually travels, as is also feasible in accordance with the principles of the invention, on a lower flight of the rail and the counter wheel adheres to an upper flight of the rail, the trolley is pivoted for removal from the rail in such a way that the wheels are positioned in approximately horizontal tandem fashion.

In accordance with the invention, no bolt connections or other mechanical assembly operations are required for installing and/or removing the trolley. In a preferred embodiment, the trolley is equipped with a single supporting or traction wheel and a single counterwheel. It may also be equipped with several supporting wheels arranged on a rocker arm, if desired in certain cases.

It has been found that a trolley truck constructed in accordance with this invention, may be guided perfectly along the rail during acceleration and deceleration, as well as when ascending or descending.

In order to establish the desired location of the center of gravity of the empty trolley, the motor driving the supporting wheel (the traction wheel) is located on the desired center of gravity side of the traction wheel, as will be understood.

The shaft of the supporting wheel and the axle of the counter wheel are arranged on a common trolley truck frame consisting of a central plate member on one side of the rail, the central plate being provided with an upper axle bearing journal box for the traction wheel and a lower axle bearing journal box for the counterwheel. The lower axle bearing journal box extends longitudinally of the trolley from the counter wheel support and intersects the vertical axis (vertical center line) of the supporting wheel. The trolley frame is equipped with a load suspension yoke which includes several bore holes for hooking up the load to the frame on a load axis displaced longitudinally from the vertical axis of the supporting wheel. If the trolley travels exclusively on a straight or downhill course, heavy loads are suspended from the bore hole nearest the vertical axis to avoid unduly excessive pressure moments. If, however, steep inclines have to be tranversed, or if the load is light, the bore hole farthest from the support wheel of the vertical axis is chosen for load suspension. This location is also laterally displaced with relation to the vertical axis of the counterwheel, due to the elevation of the counterwheel with respect to the supporting wheel on an inclined rail.

Furthermore, the trolley truck may be provided on both sides with horizontal guide wheels rotating about vertical axes and adhering to vertical bearing surfaces of the rail. When employing guide wheels, they are offset from the vertical axis, so that there are always front and rear guides for the trolley assuring proper operation.

The trolley frame is furthermore provided with an opening and a cover plate with attached current pick-ups, gliding along sliding lines which in turn are attached directly to the rail. The cover plate is, of course, somewhat larger than the frame opening and may be fastened to the frame with screws.

If the trolley is to ascend to 90° incline, the supporting wheel is provided with a rim designed as a gear rim, and the rail on this uphill stretch, is provided with a rack-like surface for cooperation with the pinion teeth on the gear rim, in known fashion. The trolley may be equipped with an additional counterwheel, which is located on the side opposite the first counterwheel. The additional counterwheel is adapted to be easily removable so that the trolley may be tilted without any great effort.

In order to carry heavy loads, several trolleys may be connected via supporting rods, the latter being attached to the load suspension yoke.

For a better understanding of the present invention and a more complete appreciation of its attendant advantages, reference should be made to the following detailed description taken in conjunction with the accompanying drawings.

DETAILED DESCRIPTION OF THE INVENTION

Figure 1:
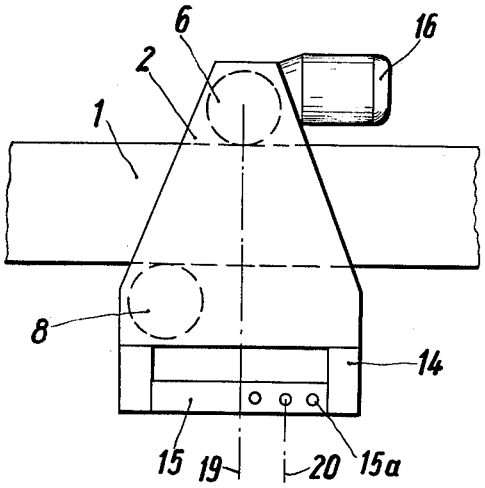
FIG. 1 is a schematic side elevational view of the trolley of the invention arranged to traverse a horizontal rail.

FIG. 1 shows a trolley truck 2 at a horizontal rail 1. A counterwheel 8 is arranged on one side of vertical axis (center line) 19 of a supporting or traction wheel 6, and the drive motor 16 for the wheel 6 is arranged on the other side. The location of motor 16 results in the center of gravity axis 20 of the empty trolley 2 being on the side of vertical axis 19 away from the counterwheel 8. With this center of gravity arrangement, the trolley 2 tends to be rotated about the axis of the supporting wheel 6, by the created moment, in a manner in which counterwheel 8 is urged against the rail from below. When the trolley is loaded, the resultant center of gravity remains on the same side of trolley 2 to preserve this beneficial tilting effect. To this end, a load suspension yoke 15 is attached to trolley 2 with arms 14 having bore holes 15a to suspend loads to be transported on the remote side of the counterwheel 8.

Figure 2:
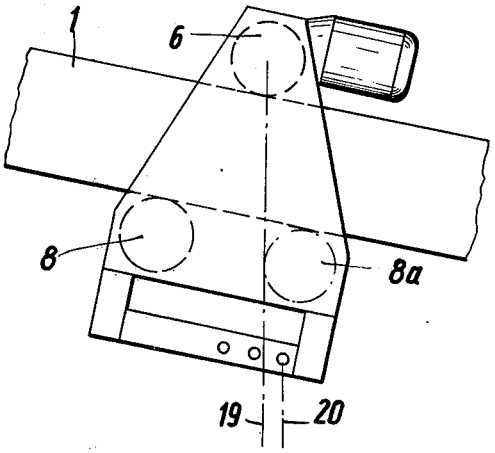
FIGS. 2 and 3 are schematic side elevational views of the trolley of the invention traversing inclined rails.

FIG. 2 shows the trolley on a rail sloping towards the right with the counterwheel 8 being tilted upwards compared with its normal position (FIG. 1). The load in this case is attached to trolley 2 far enough away from counterwheel 8 so that the vertical axis 19 is between center of gravity axis 20 and the counterwheel 8. In a steeper incline of the rail 1, the vertical axis 19 moves to the point where it coincides with center of gravity axis 20. The trolley then tilts around supporting wheels 6, and counterwheel 8 no longer adheres to the lower bearing surface of rail 1. In this position, the trolley will no longer be guided. In order to avoid this, another counter wheel 8a is attached to the other end of the trolley.

Figure 3:
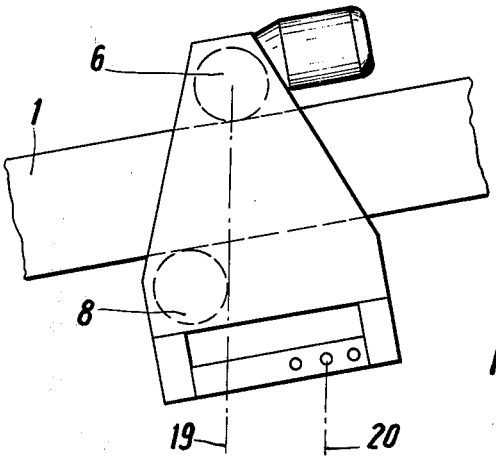

FIG. 3 shows the rail 1 sloping towards the left with a trolley having a vertical axis 19 located adjacent the couterwheel 8. Even if the degree of incline of the rail is steeper, as long as the vertical axis 19 is located between the counterwheel 8 and the center of gravity axis 20, the supporting wheel 6 and the counterwheel 8 will firmly adhere to the upper and lower bearing surfaces of rail 1 due to the leverage of moment on the trolley caused by the load.

As will be appreciated, the trolley of this invention may be used for travel in both directions along rail 1 despite its asymmetrical design. This, of course, is advantageous for changes or switches in direction in the transportation of loads.

Figure 4:
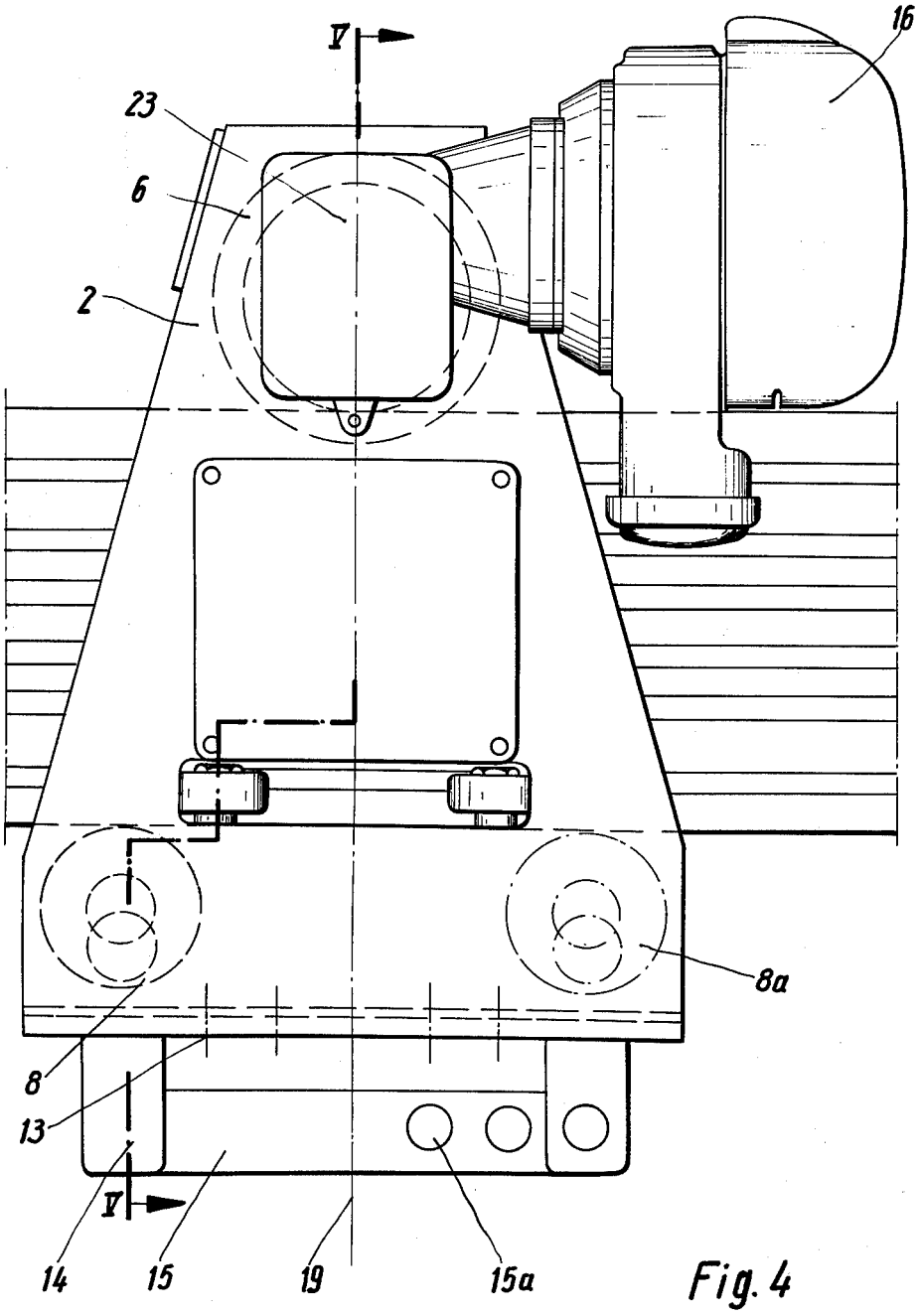
FIG. 4 is an enlarged side elevational view of the trolley of the invention.
Figure 5:
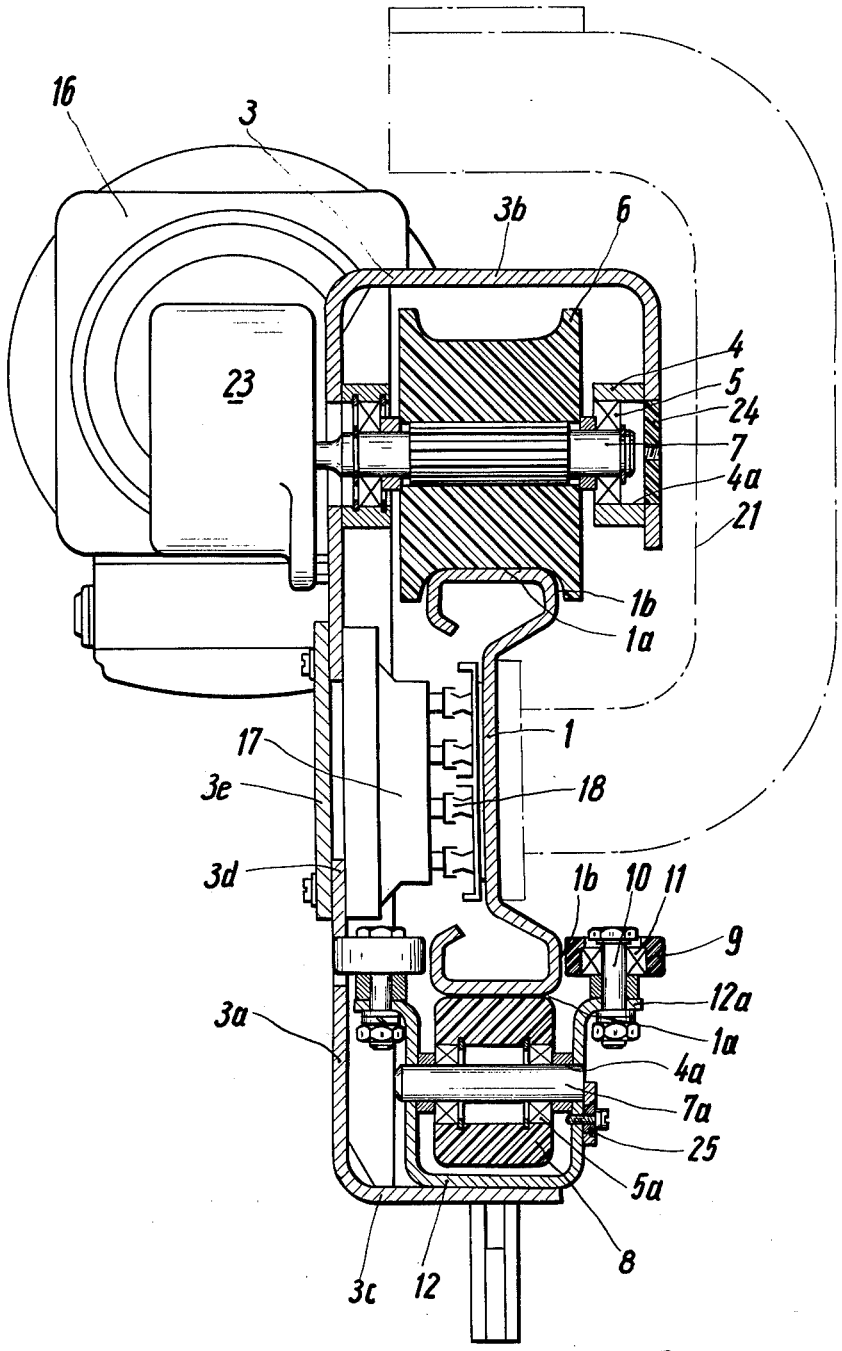
FIG. 5 is a cross-sectional view of the trolley taken along line V—V of FIG. 4.

More specifically and as shown in FIGS. 4 and 5, the trolley frame 2 has a central plate 3*a*, an upper axle bearing journal box 3*b* and a lower axle bearing journal box 3*c*. The upper axle bearing journal box 3*b* is generally U-shaped and has welded reinforcements 4 with bore holes 4*a* for bearing 5, in which shaft 7 for supporting wheel 6 is located. The bore holes 4*a* may be covered with a synthetic cap 24. The shaft 7 is connected with the motor 16 through a gear linkage 23. On the lower flange of journal box 3*c*, bracket 12 for counterwheel 8 and guide wheels 9 is attached by means of screws or the like at locations 13. Bracket 12 is also provided with reinforcements 4 with bore holes 4*a* for axle 7*a* of the counterwheel 8 which is mounted by bearings 5*a*. The end of axle 7*a* is welded to plate 25 which in turn is screwed to bracket 12, as shown in FIG. 5. Furthermore, bracket 12 has, on each side, an angular flange 12*a* for an axle 10 comprising a bolt for supporting a bearing 11 for the guide wheel 9. An opening 3*d* is formed in the central plate 3*a* and is covered by a cover plate 3*e*, to which are fastened current pick-ups 17 for cooperation with sliding lines 18 attached to the rail 1.

If the trolley is to be used on steep inclines, it is necessary to arrange, in the bracket 12, on the side of vertical axis 19 opposite counterwheel 8, an additional counterwheel 8*a*, shown in phantom. The rim of the supporting wheel 6 may then be designed as a gear rim, and the rail in the area of the incline may be equipped with the cooperating rack. As shown in FIG. 5, the rail 1 has upper and lower horizontal bearing surfaces 1*a* for supporting the wheel 6 and the counterwheel 8, respectively, and the rail 1 also has lateral bearing surfaces 1*b* for engaging the rims of the supporting wheel 6 and the counterwheel 8, respectively, and the rail 1 also has lateral bearing surfaces 1*b* for engaging the rims of the supporting wheel 6 and the counterwheel 8, respectively, or for engaging guide wheels 9. The rail 1 is supported by a C-shaped structural member 21 shown in phantom (FIG. 5).

In accordance with the invention, for removal, the trolley 2 is simply tilted away from the rail 1 so that the counterwheel 8 is located directly beneath the supporting wheel 6 on a common vertical axis. Then trolley 2 is lifted up and pulled sideways over upper bearing surface 1*a* of rail 1 with gear rim of the supporting wheel 6 clearing the rail surface 1*a*. (If the trolley was provided with the additional counterwheel 8*a*, the wheel 8*a* is disassembled before tilting the trolley by first removing axle 7*a*, as will be understood).

It should be understood that the improved monorail trolley truck and rail construction herein illustrated and described is intended to be representative only, as certain changes may be made therein without departing from the teachings of the disclosure. Accordingly, reference should be made to the following appended claims in determining the full scope of the invention.

I claim:

1. An improved trolley structure adapted to travel on a rail having predetermined spaced upper and lower beam surfaces, comprising a. a truck means mounting a traction wheel and a counterwheel for engaging said upper and lower rail surfaces, respectively, b. said traction wheel and said counterwheel being spaced apart by a distance greater than the predetermined direct vertical distance between said upper and lower beam surfaces, c. the center of gravity of said trolley being laterally displaced with respect to the point of contact between the rail and said traction wheel on the rail, whereby said counterwheel is urged against said rail by said trolley in both loaded and unloaded states, d. motor means mounted on said truck means for driving said traction wheel, e. said motor means being located on one side of the trolley to establish the center-of-gravity of said trolley at one side, f. said truck means including a common frame supporting axle means for said traction wheel and said counterwheel, g. said common frame including a central plate adapted to be disposed at one side of said rail and provided with upper journal box means for supporting bearings for said traction wheel and lower journal box means for supporting bearings for said counterwheel, and h. said lower journal box means extends longitudinally to said rail from the axis of said counterwheel and intersects the vertical axis of said traction wheel.

2. The trolley structure according to claim 1, in which:

a. a load suspension yoke means is fastened to said lower journal box means.

3. The trolley structure of claim 2, in which a. said load suspension yoke means includes a plurality of bore holes for suspending a load on the side of the common frame remote from the counterwheel.

4. A trolley structure adapted to travel on a rail having horizontal upper and lower traction surfaces, vertically spaced apart a predetermined distance from each other, comprising:

a. a vertical frame extending between said upper and said lower traction surfaces, b. a traction wheel mounted for rotation in said frame for engaging said upper traction surface, c. a counterwheel mounted for rotation in said frame for engaging said lower traction surface, d. the engaging surfaces of said traction wheel and said counterwheel being spaced apart a predetermined vertical distance greater than said predetermined vertical distance of said upper and lower traction surfaces of said rail to be engaged, e. the center of gravity of said trolley structure being laterally displaced from a vertical plane passing through the axis of said traction wheel, and f. said counterwheel being mounted in said vertical frame on the side of said vertical plane passing through the axis of said traction wheel opposite to said center of gravity of said trolley structure to urge said counterwheel against said lower traction surface in both loaded and unloaded condition.

5. The trolley structure of claim 4, further characterized in that a. said common frame includes a central plate adapted to be disposed at one side of said rail and provided with upper and lower journal box means for supporting bearings for said traction and counterwheels.

6. The trolley structure of claim 4, further including a. guide wheels rotating aroung vertical axes and adapted to engage vertical lateral guide surfaces included on said rail.

7. The trolley structure of claim 4, in which a. said frame includes an opening and a cover plate means therefor, b. current pick-up means for engaging sliding lines on said rail are mounted on said cover plate means.

8. The trolley structure of claim 4, which includes:

a. a motor on said frame adjacent said traction wheel to drive said traction wheel, and b. said motor being mounted to one side of said vertical plane passing through said traction wheel axis to establish said center of gravity of said trolley structure.

9. The trolley structure of claim 4, which includes:

a. a second counterwheel for engaging said lower traction surface, and b. said second counterwheel being disposed on the side of said vertical plane passing through said traction wheel axis opposite the first mentioned counterwheel.

* * * * *